US010214911B2

(12) United States Patent
Ragula et al.

(10) Patent No.: US 10,214,911 B2
(45) Date of Patent: Feb. 26, 2019

(54) AUTOMATED SHINGLE APPLICATION SYSTEM

(71) Applicants: Kanishka Ragula, Salt Lake City, UT (US); Vikrant Ragula, Salt Lake City, UT (US)

(72) Inventors: Kanishka Ragula, Salt Lake City, UT (US); Vikrant Ragula, Salt Lake City, UT (US)

( * ) Notice: Subject to any disclaimer, the term of this patent is extended or adjusted under 35 U.S.C. 154(b) by 0 days.

(21) Appl. No.: 15/461,370

(22) Filed: Mar. 16, 2017

(65) Prior Publication Data

US 2017/0204614 A1 Jul. 20, 2017

Related U.S. Application Data

(60) Provisional application No. 62/308,869, filed on Mar. 16, 2016.

(51) Int. Cl.
*E04D 15/06* (2006.01)
*E04D 15/02* (2006.01)
*B65H 35/04* (2006.01)

(52) U.S. Cl.
CPC ..... *E04D 15/06* (2013.01); *B65H 35/04* (2013.01); *E04D 15/02* (2013.01); *B65H 2701/1922* (2013.01)

(58) Field of Classification Search
CPC ..... E04D 15/02; E04D 15/04; E04D 15/06; E04D 15/07; B60P 1/5433; B65H 35/04; B65H 2701/1922; E04G 23/0281; B66C 23/20
USPC ..... 52/746.11, 747.1, 748.1, 749.12; 414/542, 543, 544; 81/45
See application file for complete search history.

(56) References Cited

U.S. PATENT DOCUMENTS 3,769,916 A * 11/1973 Hogan ..... E04D 15/02 104/173.1
4,265,387 A * 5/1981 Strouse ..... B27F 7/006 227/111
4,656,808 A * 4/1987 Mansfield ..... E04D 15/02 221/240
4,700,526 A * 10/1987 McGuinness ..... E04D 15/02 227/111
4,785,606 A * 11/1988 Burton ..... E04D 15/025 52/749.12
5,081,815 A * 1/1992 Carnell ..... E04D 15/02 227/110
5,169,048 A * 12/1992 Himebaugh ..... B27F 7/006 227/111
5,197,257 A * 3/1993 Nietling ..... E04D 15/02 182/45
5,205,103 A * 4/1993 Burton ..... E04D 15/02 182/45
5,381,597 A * 1/1995 Petrove ..... E04D 15/02 227/111
6,039,194 A * 3/2000 Beeche ..... B66C 23/20 180/411
6,401,426 B1 * 6/2002 Alderman ..... E04D 13/1625 52/745.06
6,543,126 B1 * 4/2003 Hamlin ..... E04D 15/04 29/822

(Continued)

*Primary Examiner* — Ryan D Kwiecinski
*Assistant Examiner* — Matthew J Gitlin
(74) *Attorney, Agent, or Firm* — Alpine IP PLLC; David A. Jones

(57) ABSTRACT

A system that automates the application of shingles to the roof of a building.

20 Claims, 5 Drawing Sheets

(56) References Cited

U.S. PATENT DOCUMENTS

| | | | | |
|---|---|---|---|---|
| 6,695,326 | B2 * | 2/2004 | Morrow | B62B 3/00 280/79.11 |
| 6,782,972 | B1 * | 8/2004 | Hatch | E04D 15/00 182/102 |
| 7,552,976 | B2 * | 6/2009 | Brown | E04D 15/003 299/39.2 |
| 7,802,854 | B1 * | 9/2010 | Lane | E04D 15/02 299/37.1 |
| 9,376,818 | B1 * | 6/2016 | Kelly | E04D 15/06 |
| 2005/0207873 | A1 * | 9/2005 | Endrud | E04D 15/02 414/10 |
| 2006/0101782 | A1 * | 5/2006 | Sanders | B66F 9/18 52/749.1 |
| 2007/0059142 | A1 * | 3/2007 | Dambroseo | B66C 23/205 414/561 |
| 2007/0079518 | A1 * | 4/2007 | Martin | E04G 21/3276 33/645 |
| 2007/0245684 | A1 * | 10/2007 | Bremer, Jr. | E04D 15/003 52/749.12 |
| 2008/0309033 | A1 * | 12/2008 | Twardzik | A47C 9/027 280/32.5 |
| 2009/0226282 | A1 * | 9/2009 | Starr | E04B 7/028 414/10 |
| 2010/0037540 | A1 * | 2/2010 | Atkins | B26D 1/025 52/173.1 |

* cited by examiner

AUTOMATED SHINGLE APPLICATION SYSTEM

CROSS-REFERENCE TO RELATED APPLICATIONS

This application claims the benefit of and priority to U.S. provisional patent application 62/308,869 filed Mar. 16, 2016, the contents of which are incorporated by reference herein.

BACKGROUND

The present invention is in the technical field of construction. More particularly, the present invention is in the technical field of roofing, providing an automated means of applying shingles to the roofs of all types of buildings.

The subject matter claimed herein is not limited to embodiments that solve any disadvantages or that operate only in environments such as those described above. Rather, this background is only provided to illustrate one exemplary technology area where some embodiments described herein may be practiced

SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

A system for automating application of shingles to a roof is disclosed. The system includes a repositionable support structure and a shingle applicator connected to the repositionable support structure, the shingle applicator comprising means for applying a shingle to the roof.

The repositionable support structure can include an arm extending therefrom for overhanging placement of the shingle applicator therefrom to the roof. The repositionable support structure can include an adjustable vertical support and an adjustable horizontal support. The repositionable support structure can include a rotational support structure for rotating the shingle applicator about one or more axis.

The system can further include a vehicle supporting the repositionable support structure. The repositionable support structure can further include a roof support, the roof support can include a shaft and follower structure for support by the roof.

The roof support can be disposed opposite to a ground supported gantry support, wherein the shingle applicator is repositionable about a gantry disposed the roof support and the gantry support.

The repositionable support structure can include an anchoring vehicle, a vertical gantry support, a horizontal gantry, and a gantry rotation apparatus. The repositionable support structure can include an elevator translation apparatus, an elevator translation motor, and an elevation apparatus. The repositionable support structure can include an elevator translation apparatus, an elevator translation motor, an elevation apparatus, and a roof follower shaft. The repositionable support structure can include a roof follower structure and a roof follower roller.

The shingle applicator can be detachable. The shingle applicator can further include a transportation mechanism for driving the shingle applicator to different locations of the roof.

Methods for applying shingles to a roof are disclosed. The methods can use the systems or components thereof disclosed herein. The method can include repositioning the shingle applicator to different horizontal and vertical locations of the roof using the support structure. The methods can include applying the shingles to the roof using the shingle applicator.

Various shingle applicators are disclosed. A shingle applicator can include a roll of shingle material. The shingle applicator can include a feeding mechanism. The shingle application mechanism being used for applying the shingle material to a roof.

A shingle applicator can further include a cutting mechanism for cutting the roll of shingle material into individual shingles, the shingle application mechanism being configured to apply the individual shingles to the roof.

Systems for automating application of shingles to a roof are disclosed. The systems can include a shingle applicator and a repositionable support structure. The shingle applicator can be connected to the repositionable support structure. The shingle applicator can include means for applying a shingle to the roof. The systems and single applicators can also include means for performing the functions disclosed herein as structurally discusses and equivalents thereof.

Method of controlling a shingle applicator are disclosed. The methods can include controlling the respositionable support structure to reposition the shingle applicator at different positions of the roof. The methods can include causing the shingle applicator to apply shingles at the different locations of the roof.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION AND BEST MODE OF IMPLEMENTATION

Figure 1:
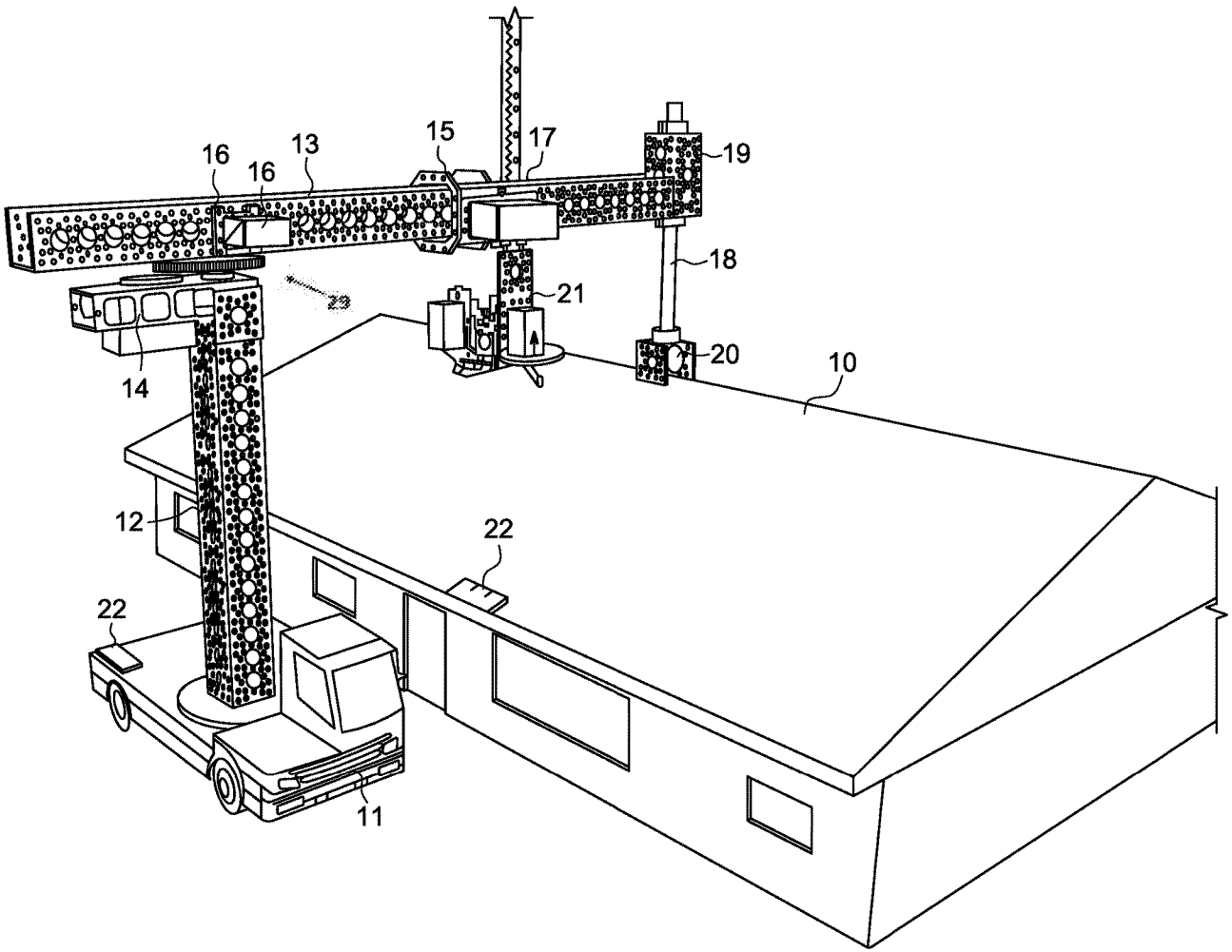
FIG. 1 illustrates a perspective diagram view of the chief elements of the present invention.

Referring now to the invention in more detail, in FIG. 1 there is shown a roof 10, anchoring truck 11, gantry support 12, gantry 13, gantry rotation apparatus 14, elevator translation apparatus 15, elevator translation motor 16, elevation apparatus 17, roof follower shaft 18, roof follower structure 19, roof follower roller 20, shingle applicator apparatus 21, shingles 22.

In more detail, still referring to the invention of FIG. 1, roof 10 is shown as the surface onto which shingles are applied in an automated fashion. Roof 10 surfaces are defined as any surfaces that are covered with shingles 22. Anchoring truck 11 provides structural support for vertically extending gantry support 12 including a plurality of vertically extending support members which in turn is affixed to gantry 13 through horizontally extending gantry rotation apparatus 14 including a plurality of horizontally extending support members, the rotational apparatus 14 including a rotational gear 29 for rotation of the horizontal gantry about the vertical gantry support. Although a preferred embodiment of this invention is to affix the gantry 12 to truck 11 in practice any means of anchoring the gantry support 12 in a fashion substantial enough to support gantry 13 and its associated mechanisms is an intended embodiment of this invention. The gantry rotation apparatus 14 rotates gantry 13 left and right from the center of the roof 10 positioning the elevator translation apparatus 15 over the roof 10 at a position above the intended fixing location of the shingle 22. The roof follower roller 20 rolls in contact with the peak of roof 10 providing both a support for the gantry 13 and a reference to the roof 10 as it rolls left and right with the movement of gantry 13. The roof follower roller 20 stays aligned with the roof 10 via the rotation of the roof follower shaft 18 which is in turn captured by the roof roller structure 19. Gantry translation motor 16 further refines and positions the elevation apparatus 17 moving it parallel to the gantry 13 and stopping above the desired shingle 22 fixing position. Subsequent to positioning the elevator translation apparatus 15 at the correct position along the gantry 13, the elevation apparatus 17 moves the shingle apparatus 21 in a motion perpendicular to gantry 13 until it is in a proximity to the surface of roof 10 and will allow the shingle application apparatus 21 to fix a shingle 22 to the roof 10. It is further disclosed that the mechanisms described in this invention are controlled by a plurality of computers, electronic controls and associated sensors as needed to automate the roofing process using automated computer programs and operator controls.

The implementation details of the invention as shown in FIG. 1 are that a structure overhangs a roof 10 in a manner and containing the movable mechanisms necessary to position an automated shingle application apparatus 21 in a position in the proximity to the roof 10 subsequently affixing a shingle 22 to said roof 10 using automated machines rather than human means.

Figure 2:
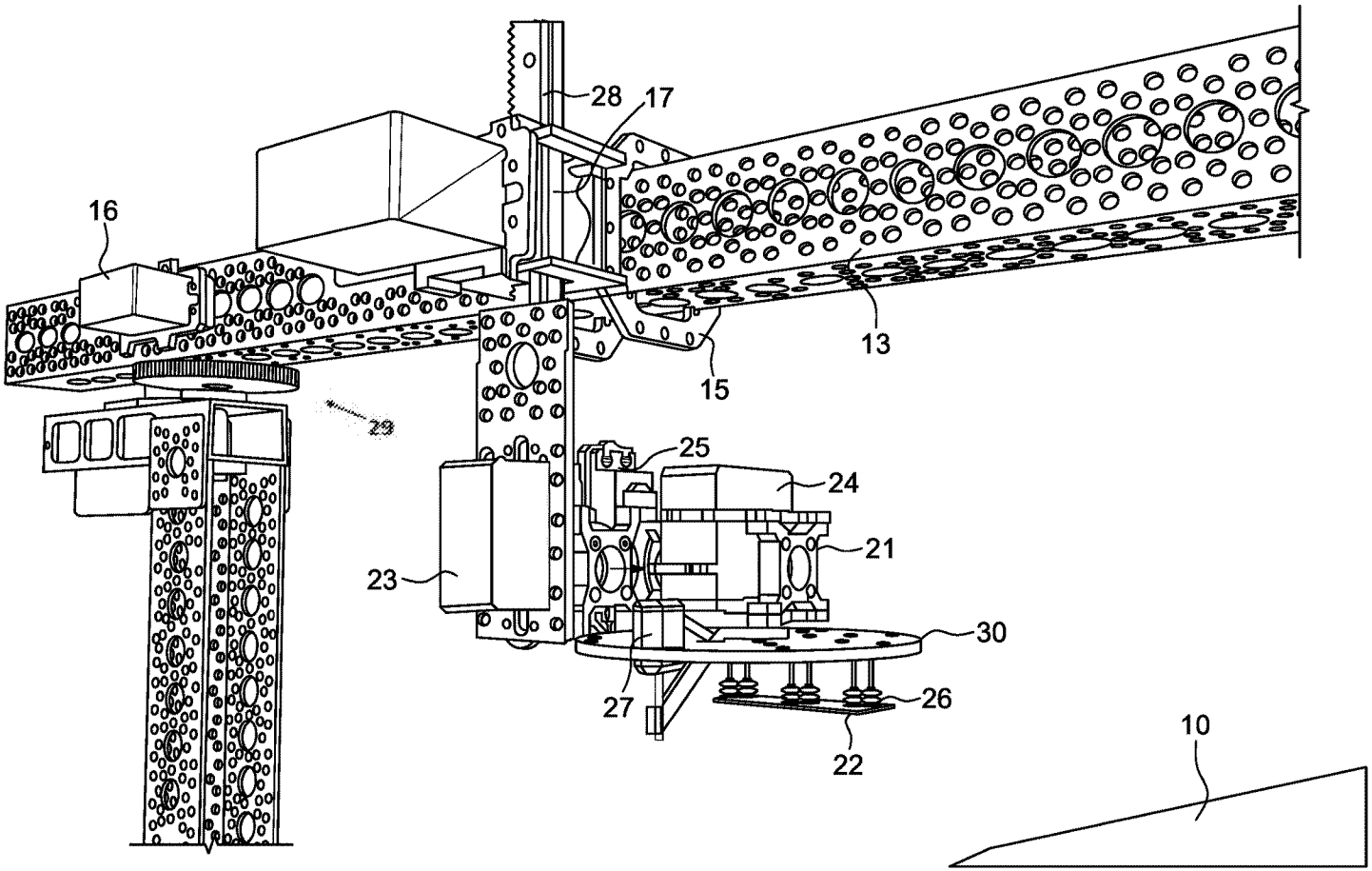
FIG. 2 illustrates a detailed perspective diagram view of the translating mechanisms of FIG. 1.

Referring now to the invention shown in FIG. 2 there is shown a more detailed view including the gantry 13, elevator translation apparatus 15, elevator translation motor 16, elevation apparatus 17, shingle applicator apparatus 21, shingle 22, applicator axis A mechanism 23, applicator axis B mechanism 24, applicator axis C mechanism 25, applicator platform 30, shingle pickup mechanism 26, shingle fastener mechanism 27, rack and pinon mechanism 28, and roof 10.

In more detail, still referring to the invention of FIG. 2, the elevator translation apparatus 15 is affixed to gantry 13 in a manner that will allow it to slide along and in parallel to gantry 13 as moved by the elevator translation motor 16. Elevation apparatus 17 is moved perpendicular to gantry 13 employing but not limited to a rack and pinon 28 gearing means. Shingle applicator apparatus 21 is positioned to align with the angle of the roof and the angular position of the gantry 13 relative to the roof 10 using three rotational mechanisms including, applicator axis A mechanism 23, applicator axis B mechanism 24 and applicator axis C mechanism 25. The mechanisms affixed to the shingle application apparatus 21 such as but not limited shingle fastening apparatus 27 and shingle pickup mechanism 26 are positioned to align with the roof for shingle pickup and fastening by rotating one or more of the applicator axis A mechanism 23, applicator axis B mechanism 24, applicator axis C mechanism 25. Shingle fastener mechanism 27 and shingle pickup mechanism 22 are affixed to applicator platform 30. A shingle fastener mechanism 27 may employ a plurality of means for feeding and subsequently driving nails or staples into the shingles. The shingle fastener mechanism 27 may be but is not limited to being powered by air, hydraulics or electric means. Shown in FIG. 2 is a vacuum means of implementing the shingle pickup mechanism 26 to pick up and retain a shingle 22 while moving it from its storage location to the roof 10. A shingle pickup mechanism 26 may by design employ a plurality of mechanical means for gripping shingles including but not limited to vacuum pickups and robotic grippers.

The implementation details of the invention as shown in FIG. 2 are that moveable gantry 13, elevator apparatus 17, applicator axis A mechanism 23, applicator axis B mechanism 24, applicator axis C mechanism 25 are employed to position a shingle application apparatus 21 in position on a roof 10 which further employs a plurality of shingle fastener mechanisms 27 and shingle pickup mechanisms 26 to automate the process of properly affixing shingles to a roof 10.

Figure 3:
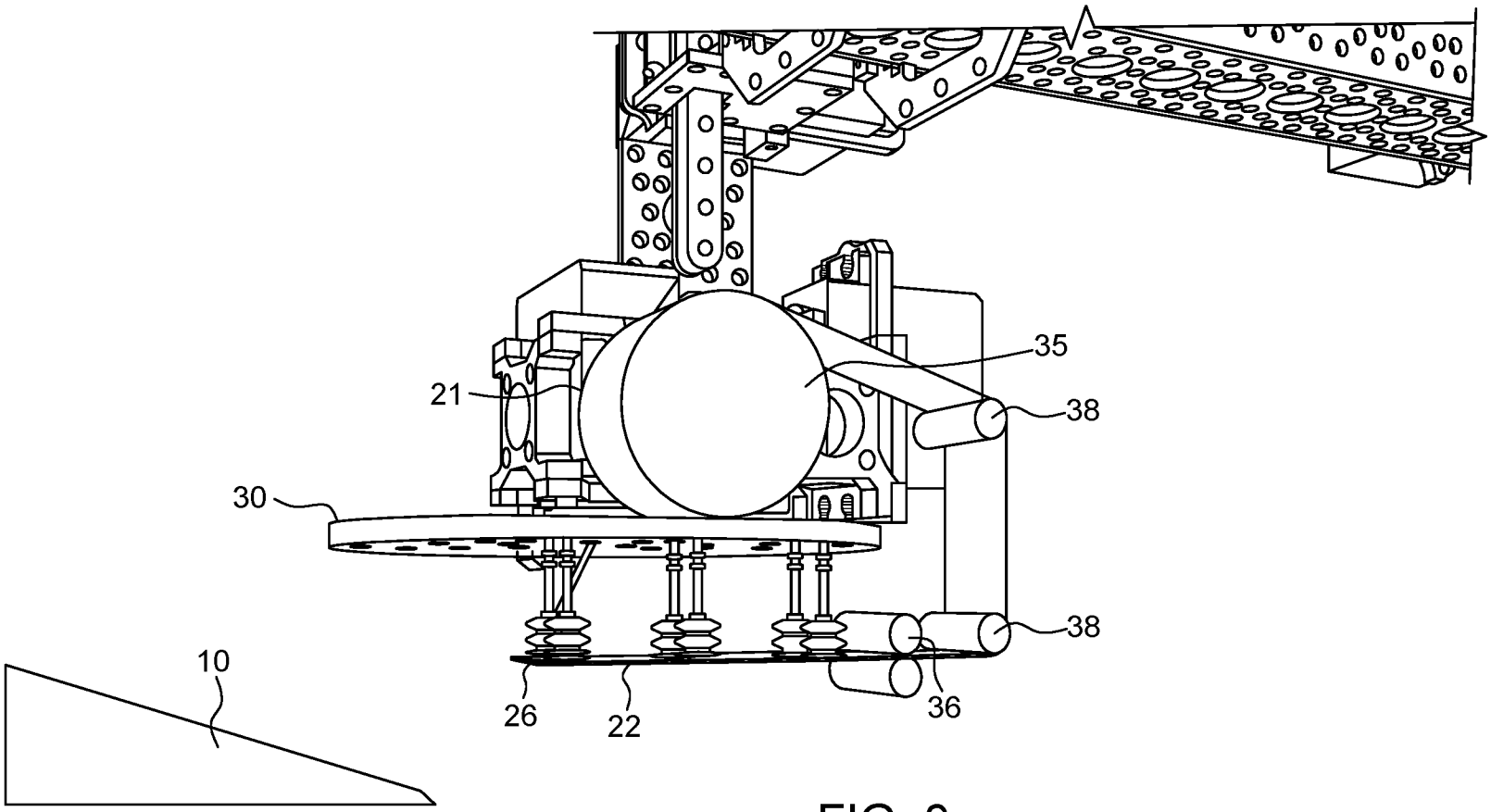
FIG. 3 illustrates a detailed perspective view of the shingle applicator apparatus of FIG. 2 employing an alternate shingle handling apparatus.

Referring now to the invention shown of FIG. 3 there is shown shingle applicator apparatus 21, shingle pickup apparatus 26, shingle roll 35, shingle cutter 36 shingle feed rollers 38.

In more detail still referring of FIG. 3 shown is an alternate embodiment which fabricates shingles 22 from a shingle roll 35 that is affixed to applicator platform 30. In operation, the shingle feed rolls 38 pull the material on shingle roll 35 into the shingle cutter 36 where the shingle material is cut to size. The shingle pickup apparatus 26 holds the cut shingle 22 for subsequent placement on the roof 10.

The implementation details of the invention as shown in FIG. 3 are that a shingle roll 35 is added to the shingle application apparatus 21 as an embodiment to the inventions described in FIG. 1 and FIG. 2. Employing a shingle roll 35 eliminates the need to pick and place singles 22 one at a time improving the speed and efficiency with which a roof 10 can be shingled.

Figure 4:
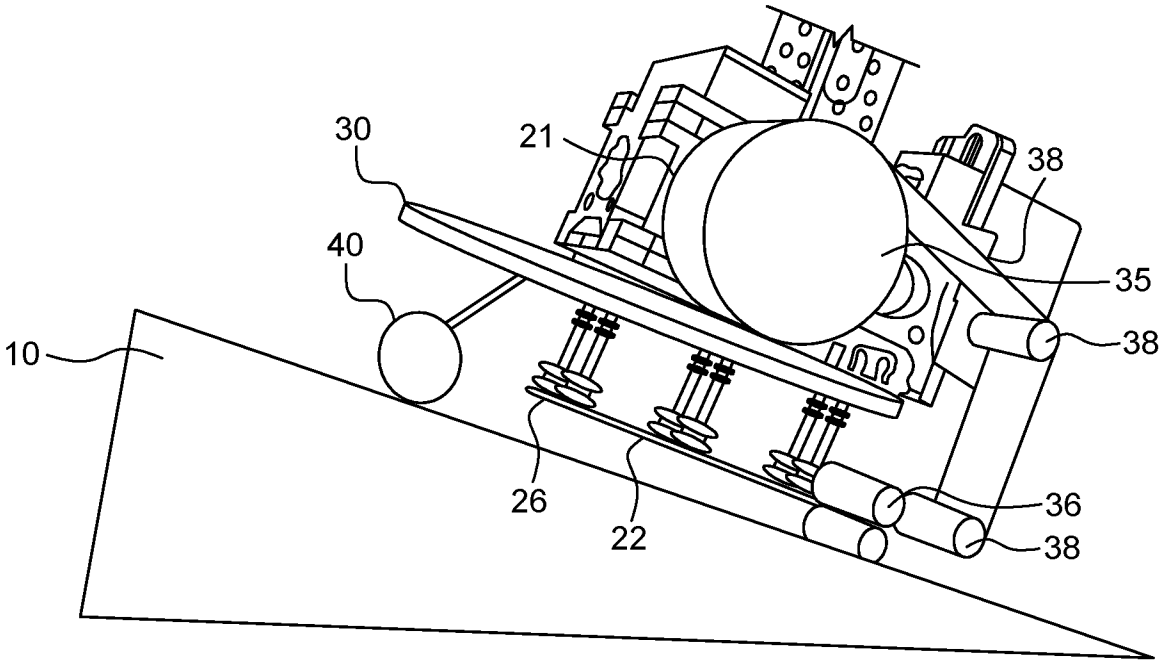
FIG. 4 illustrates a shingle applicator including a transportation means.

Referring to FIG. 4, the shingle applicator 21 can be detachable from the gantry 13. The shingle applicator 21 can include transportation means 40. The transportation means can include one or more wheels for repositioning the shingle applicator about the roof independent of the gantry 13. The shingle applicator need not have the roll of shingle material as depicted from FIG. 3, however, the combination of the roll of shingle material for autonomous application of singulated singles can find particular improvements. For example, the support structure placing the applicator 21 on the roof may place additional shingle applicators 21 on different roofs or different portions of the same roof. Thus, multiple or single shingle applicators 21 may be implemented on the same roof or delivered to different roofs for parallel or serial application of shingles thereto.

The location of the shingle applicator 21 can be coordinated with other autonomous or gantry 13 positioned shingle applicators 21. Thus, a first shingle applicator 21 can be assigned, positioned, or controlled so as to apply shingles to a first portion of the roof 10 while another shingle applicator 21 can be simultaneously or serially assigned, positioned, or controlled so as to apply shingles to a second portion of the roof 10. The assignment can be serial in that when a first supply of shingles 22 or shingle material 35 is depleted a second applicator may take over the application of shingles 22 where the previous shingle applicator 21 left off. Thus, the number of shingle applicators 22 deployed to a location can coincide with an amount of shingles 22 or shingle material 35 required by the roof 10 without the requirement of recharging the shingles 22 or shingle material 35 of a shingle applicator 21.

As previously mentioned the shingle applicator 21 can be detachable. Thus a multitude of shingle applicators 21 can be deployed to a location or carried by the vehicle 11. The different shingle applicators 21 can be attached and de-attached to the gantry 13. Similarly, the vehicle can carry multiple cartridges of shingles or rolls of shingle material for automatic, semi-automatic, and/or manual refilling of the shingle applicator.

Moreover, different applicators 21 or different cartridges of shingles 22 or rolls of shingle material 35 can have different properties. Certain properties may have different colors for different effects of application of shingles 22 to the roof 10. The shingle applicator 21 can also have multiple cartridges of shingles 22 or rolls of shingle material 35 so as to alternate between shingle characteristics. The shingle characteristics can also be associated with a roughness. In the instance of ceramic tile shingles a cartridge or shingle applicator head can be associated with placement of a tile and a different cartridge or shingle applicator can be associated with a joint, edge piece, crown or other various different types of shingles and tiles.

Figure 5:
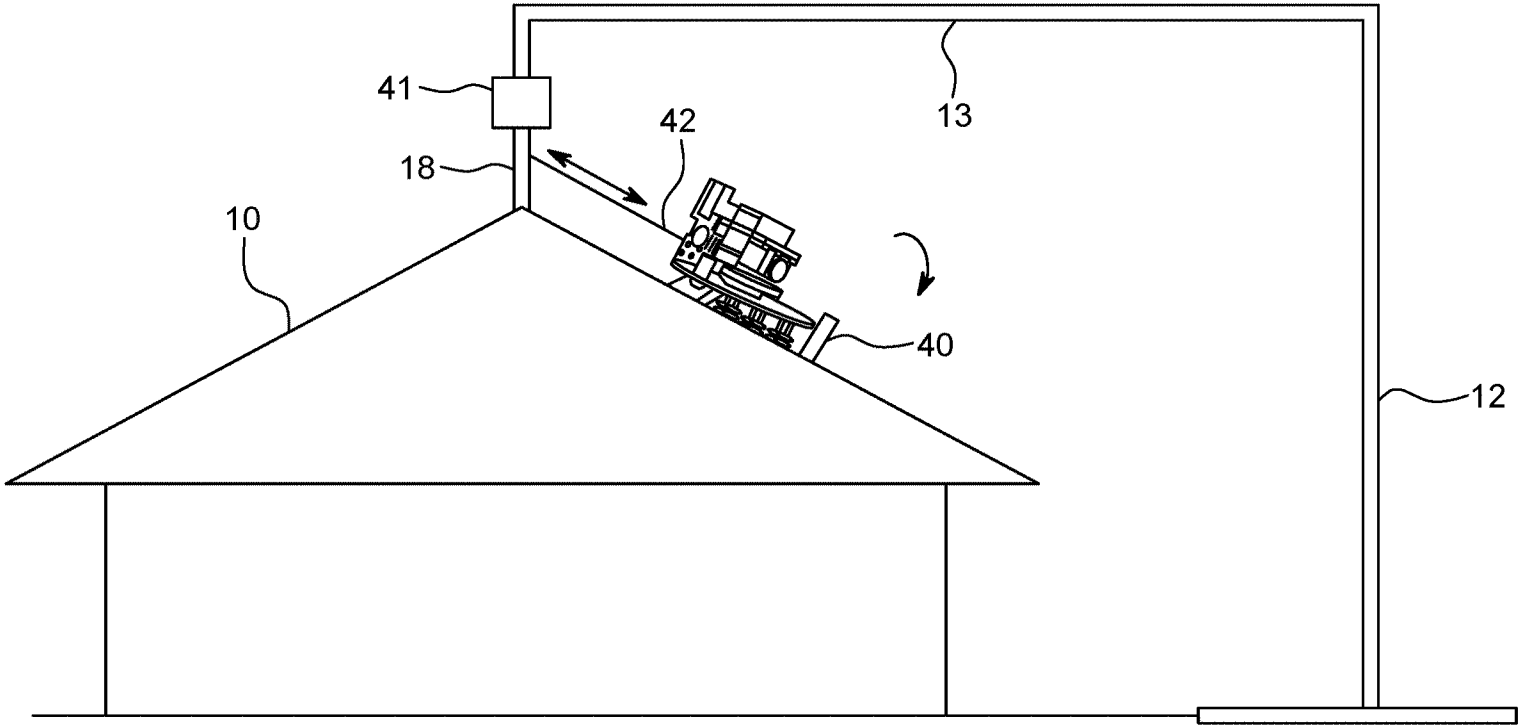
FIG. 5 illustrates a tethered shingle applicator.

Referring to FIG. 5, the shingle applicator 21 can be tethered 42 to a support. The support can include a shaft 18. The shaft 18 can be attached to the gantry 13 and gantry support 12 as shown by FIG. 5. As shown in FIG. 5, the gantry support 12 can be supported by the ground and left at the location of the roof 10 while shingles 22 are applied by the shingle applicator 21.

The shingle applicator 21 can be connected to the support 18 by the tether 42. The tether 42 can be rigid or can include a flexible cable. The tether 42 can be adjustable in length or adjust the distance between the shingle applicator 21 and the support 18. Similar to that shown in FIG. 1, the support 18 can be repositionable along a ridge of the roof 10. Similarly, the shingle applicator 21 can include the transportation mechanism for horizontal repositioning consistent with the location of the support 18 as illustrated in FIG. 1.

The system can further include a controller 41. The controller 41 can adjust the distance of the tether 42 for example via a reel of the controller 41. The controller 41 can communicated with the transportation mechanism 40 of the shingle applicator 21 so as to coordinate the location of the shingle applicator 21 and application of the shingles to the roof 10.

According to additional embodiments, as illustrated in FIG. 5 a central stationary position of the support 18 can define a polar center for use of the shingle applicator 21 on a conical roof 10. Thus, application of the shingles 22 to a conical roof 10 would be controlled by a polar rotation and radial distance defined by the tether 42 and the polar angle as coordinated by the controller 41 and transportation mechanism 40. The tether 42 can be attached to a reel of the controller 41 to change the distance of the tether 42 or the tether 42 may be wound around the support 18. The diameter of the support 18 can be selected so as to coincide with a width of shingle 22 so as to progressively shorten the length of tether 42 as it is wound around the support 18. In such instance, the controller 41 may be disposed on the applicator 21. The distance traveled around the conical roof 12 can be associated with a calculation of the polar distance traveled during application of the shingles 22 to determine the amount of singles 22 or material 35 needed. As common in shingling a traditional roof 10 portion from top to bottom and side to side a polar method of shingling a conical roof 10 can be defined by a gradually outward and radially winding configuration.

The controller 41 can include various sensors for discovery of the roof 10. The sensors of the controller 41 can include optical, sound, and touch sensors. The sensors can detect edges, inclination, and distances related to the roof 10. The sensors can be located on the application device 21, on the controller 41 or the sensors can be disposed on the gantry 13 and communicate with the controller 41.

The advantages of the present invention include, without limitation, an automated means of applying shingles to a roofs surface eliminating the cost, safety and time constraints traditionally experienced using manual human means.

In broad embodiment, the present invention includes a system that automates the application of shingles to a building's roof.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A system for automating application of shingles to a roof, comprising:

an anchoring ground supported vehicle;

a repositionable support structure supported by the vehicle, the repositionable support structure including:

a vertical gantry support including a plurality of vertically extending support members;

a horizontal gantry including a plurality of horizontally extending support members, the horizontal gantry rotationally supported by the vertical gantry support and disposed perpendicular to the vertical gantry support;

a gantry rotational apparatus including a rotational gear for rotation of the horizontal gantry about the vertical gantry support; and an elevation apparatus, the elevation apparatus moving a shingle applicator vertically perpendicular to the horizontal gantry and parallel to the vertical gantry support until the shingle applicator is in a proximity to a surface of the roof, the elevation apparatus including:

an elevator translation motor; and a rack and pinion gear drive; and the shingle applicator including:

a shingle pickup apparatus that holds shingles for subsequent placement on the roof; and a shingle fastener mechanism for fastening shingles to the roof.

2. A system according to claim 1, the repositionable support structure further comprising a roof support, the roof support including a shaft and follower structure for support by the roof.

3. A system according to claim 2, wherein the roof support is disposed opposite to the gantry support, wherein the shingle applicator is repositionable about the gantry.

4. A system according to claim 1, the repositionable support structure including:

a roof follower structure; and a roof follower roller.

5. A system for automating application of shingles to a roof, comprising:

a repositionable support structure, the repositionable support structure including:

a vertical gantry support including a plurality of vertically extending support members;

a horizontal gantry including a plurality of horizontally extending support members, the horizontal gantry rotationally supported by the vertical gantry support and disposed perpendicular to the vertical gantry support;

a gantry rotational apparatus including a rotational gear for rotation of the horizontal gantry about the vertical gantry support;

an elevation apparatus, the elevation apparatus moving a shingle applicator vertically perpendicular to the horizontal gantry and parallel to the vertical gantry support until the shingle applicator is in a proximity to a surface of the roof, the elevation apparatus including:

an elevator translation motor; and a rack and pinion gear drive; and the shingle applicator including:

a shingle pickup apparatus that holds shingles for subsequent placement on the roof;

a shingle fastener mechanism for fastening shingles to the roof; and the shingle applicator being detachable from the repositionable support structure and including one or more wheels for repositioning the shingle applicator about the roof independent of the gantry.

6. A system according to claim 5, the shingle applicator further comprising a transportation mechanism including one or more wheels for repositioning the shingle applicator about the roof independent of the gantry.

7. A system according to claim 5, further comprising a ground supported vehicle.

8. A system according to claim 5, the repositionable support structure further comprising a roof support, the roof support including a shaft and follower structure for support by the roof.

9. A system according to claim 8, wherein the roof support is disposed opposite to the gantry support, wherein the shingle applicator is repositionable about the gantry.

10. A system according to claim 5, further comprising a multitude of the detachable shingle applicators for deployment to the roof.

11. A system according to claim 10, wherein the multitude of detachable shingle applicators are coordinated, assigned, positioned, or controlled so as to apply shingles to distinct portions of the roof.

12. A system according to claim 11, wherein the assignment of detachable shingle applicators is serial in that when a first supply of shingles or shingle material is depleted a second detachable applicator takes over the application of shingles where the previous detachable applicator left off.

13. A system according to claim 10, wherein the number of the multitude of the detachable shingle applicators in the system coincides with an amount of shingles or shingle material required by the roof.

14. A system according to claim 10, the multitude of detachable shingle applicators deployed to the roof deploying shingles with different properties.

15. A system according to claim 14, the different shingle properties including a difference in shingle color.

16. A system according to claim 14, the different shingle properties including a difference in shingle type.

17. A system according to claim 16, the difference in shingle type including joint, edge piece, or crown.

18. A system according to claim 14, the different shingle properties including a difference in shingle roughness.

19. A system according to claim 10, the shingle applicator according further including a cutting mechanism for cutting the roll of shingle material into individual shingles.

20. A system according to claim 5, the shingle applicator further including:

a roll of shingle material;

a feeding mechanism; and a shingle application mechanism for applying the shingle material to a roof.

* * * * *